United States Patent [19]

Lindsay

[11] Patent Number: 4,706,347

[45] Date of Patent: Nov. 17, 1987

[54] HANGER AND CLIP THEREFOR

[76] Inventor: Brendan J. Lindsay, 9 Newhaven Street, Ellerslie, New Zealand

[21] Appl. No.: 884,515

[22] Filed: Jul. 11, 1986

[30] Foreign Application Priority Data

Jul. 15, 1985 [NZ] New Zealand ..... 212736

[51] Int. Cl.[4] ..... A44B 21/00

[52] U.S. Cl. ..... 24/517; 24/489; 24/498; 223/96

[58] Field of Search ..... 24/489, 492, 498, 502, 24/504, 505, 506, 513, 516, 517, 455; 40/21 C; 223/96

[56] References Cited

U.S. PATENT DOCUMENTS

| | | | |
|---|---|---|---|
| 1,459,735 | 6/1923 | Kraft | 24/517 |
| 1,987,159 | 1/1935 | Rasmussen | 24/517 |
| 2,013,275 | 9/1935 | Key et al. | 24/501 |
| 2,173,010 | 9/1939 | De Amario | 24/517 |
| 2,643,151 | 6/1953 | Bupancic | 24/498 |
| 2,666,240 | 1/1954 | MacCaferri | 24/501 |
| 3,135,034 | 6/1964 | Fauteux | 24/489 |
| 3,561,077 | 2/1971 | Grant | 24/517 |
| 4,177,587 | 12/1979 | Dorsen et al. | 40/21 C |
| 4,192,441 | 3/1980 | Batts | 223/96 |
| 4,194,274 | 3/1980 | Garrison . | |
| 4,395,799 | 8/1983 | Batts | 223/96 |
| 4,450,639 | 5/1984 | Duester . | |
| 4,514,885 | 5/1985 | Delahousse et al. | 24/489 |

*Primary Examiner*—Victor N. Sakran

*Attorney, Agent, or Firm*—Schwartz, Jeffery, Schwaab, Mack, Blumenthal & Evans

[57] ABSTRACT

A clip (8) for a hanger has a pair of gripping arms (9,10) pivoted together (11) which have respective free ends (13,14) which are normally biassed together. The free ends (13,14) can be opened up by pressure being applied across the respective upper portions of the gripping arms (9,10). This enables an article of clothing or the like to be inserted therebetween. A tongue (17) can be pivoted (20) on the upper end of one of the gripping arms (9) to engage within a groove in the top edge of the other gripping arm (10). This results in the free ends (13,14) being locked together therefore securing the article of clothing therebetween. An edge (22) of a flange (19) from which the tongue (17) extends, is required to be forced past projections (21) on either side of the groove to locate the tongue (17) within the groove. The edge (22) forces the top end of the arm (10) outwardly which results in the securement of the free ends (13,14) together. Various embodiments are described in which the clip (8) is provided as a discrete component movable on a hanger bar or formed integrally with the hanger bar. An embodiment is described in which the clip (8) has an aperture therein which is engageable over, to expose, a clothes size indicia provided on the hanger bar. An embodiment is also disclosed in which the hanger hook is provided as a discrete component engageable with a projection provided on the hanger bar.

12 Claims, 13 Drawing Figures

HANGER AND CLIP THEREFOR

BACKGROUND OF THE INVENTION

The present invention relates to a hanger and clip therefor.

Various types of hangers for garments and other articles are available which include garment clips or grips such as are disclosed in U.S. Pat. Nos. 4,194,274 and 4,192,441 of John Thomas Batts, Inc. Various types of hangers also include means whereby a garment size indicator can be displayed, see for example U.S. Pat. No. 4,450,639 of John Thomas Batts, Inc.

Such previous proposals have, however, suffered from various disadvantages particularly those of cost of manufacture and ease of operation. In the latter regard, it is to be appreciated that even in a relatively small economy a substantial volume of garments need to be moved on hangers from their place of manufacture to the various retail outlets whilst in large economies, such as those of the United States and the United Kingdom, these volumes can be immense. There is thus a need for a hanger which can fulfil the necessary functions with a minimum of inconvenience to the manufacturer, wholesaler or retailer.

It is an object of one embodiment of the present invention to thus provide a clip for a hanger which is operable in a speedy and effective manner to grip garments or other articles required to be suspended from the hanger.

It is an object of another embodiment of the present invention to provide a hanger in which an article size indication is provided in a speedy and effective manner.

Further objects of this invention will become apparent from the following description.

SUMMARY OF THE INVENTION

The present invention, according to one embodiment thereof, provides a clip for a hanger, said clip comprising a pair of gripping arms pivotally movable relative to one another, a locking means operable to hold said gripping arms in a first position with respective free ends of said arms biased together to grip an article placed therebetween, said locking means being releasable to permit said free ends of said arms to be moved apart to a second position for the insertion of said article therebetween.

The present invention, according to another embodiment of the invention, provides a hanger with a laterally extending hanger bar, a clip being provided thereon or being adapted to be provided thereon, said clip comprising a pair of gripping arms pivotally movable relative to one another, a locking means operable to hold said gripping arms in a first position with respective free ends of said arms biased together to grip an article placed therebetween, said locking means being releasable to permit said free ends of said arms to be moved apart to a second position for the insertion of said article therebetween which is thereby suspended from said clip and said hanger bar.

The present invention will now be described by way of example and with reference to possible embodiments thereof and with reference to the accompanying drawings.

DETAILED DESCRIPTION OF THE ILLUSTRATED EMBODIMENTS

Figure 1:
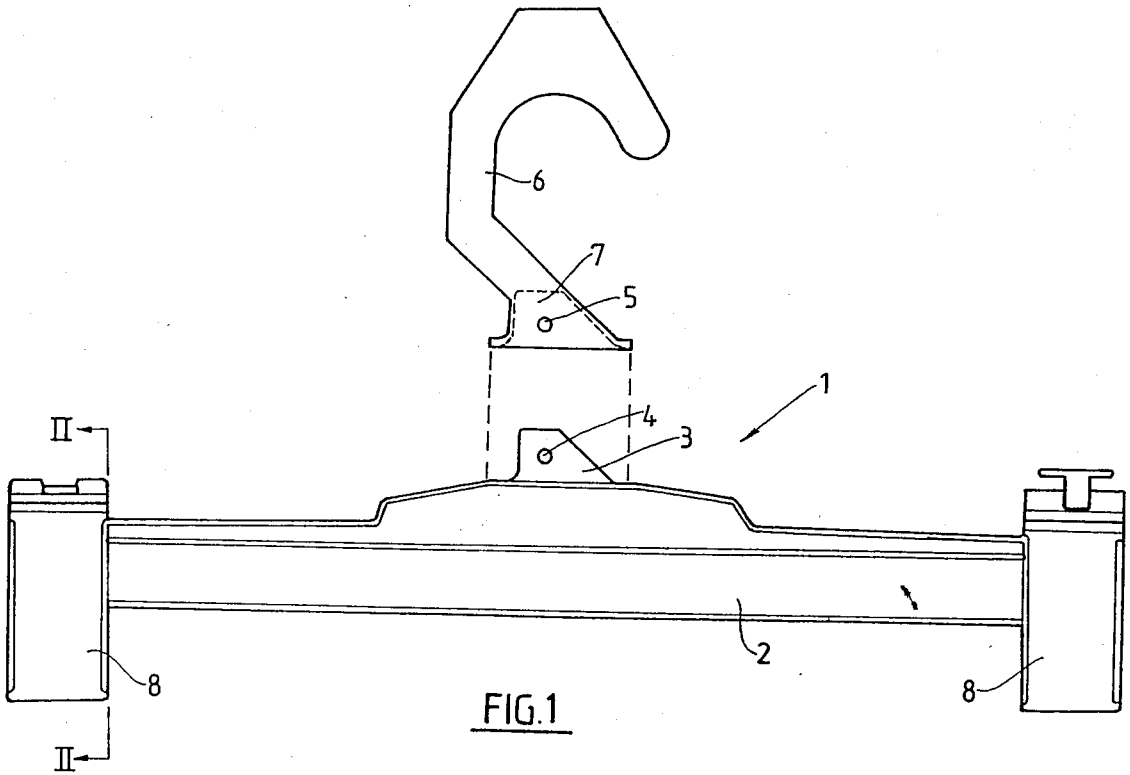
FIG. 1: shows diagrammatically a side view of a hanger according to one possible embodiment of the invention with its left hand side clip in a closed position and its right hand side clip in its open position and with its hook diagrammatically shown detached from the hanger bar.

Referring firstly to FIGS. 1 to 5 of the accompanying drawings a hanger referenced generally by arrow 1 has a hanger bar 2 which in the example shown is a single bar but which in known manner could for example be the bottom bar of a substantially triangular bar arrangement. The hanger bar 2 is shown having an upper portion provided with an upstanding projection 3 with pins or projections 4 which are engageable within apertures 5 provided in the bottom portion of a hook 6. As illustrated in outline in FIG. 1 the bottom portion of the hook 6 has a cavity 7 to accommodate the projection 3. The hook 6 can feature indicia such as garment size and/or the trade mark of the clothing company and/or the name of the store, for example, or it may be of a particular colour or combination of colours identifying a particular clothes size. In that the hook 6 and the hanger bar 2 are detachable, a change in market requirements can be readily accommodated merely by changing the hook 6 to be fitted to the hanger bar 2. While a particular pin and aperture arrangement has been shown in FIG. 1, it will be appreciated that any other suitable engagement could be provided. For example, the hook 6 could be provided with inwardly facing pins or projections which engage within an aperture through the projection 3 or, for example, the projection 3 could take the form of a pair of spaced apart walls with the hook 6 being substantially solid and being lockable in engagement between the walls.

At each end of the hanger bar 2 is shown a clip 8, the left hand clip in FIG. 1 being shown in its closed position and the right hand clip in FIG. 1 being shown in its open position.

As seen particularly from FIGS. 2 to 5, each clip 8 comprises a pair of gripping arms 9 and 10 pivotally connected together about pivot point 11 provided on a connecting arm 12. The arm 9 is shown as being substantially straight with a stepped free-end portion 13 adapted for inter-engagement with a stepped free-end portion 14 of the arm 10. The arm 10 is shown with its bottom portion 15 turned inwardly towards the arm 9. The upper portion of the gripping arm 10 has a groove 16 which can accommodate a tongue 17 having a transverse head portion 18. The tongue 17 is shown provided on a flange 19 pivoted about 20 at the upper portion of the gripping arm 9.

The inner surface of the upper portion of the gripping arm 10 is shown provided with a set of lugs 21 towards the top of the groove 16. These lugs 21 assist in the locking of the tongue 17 in position, the edge 22 of the flange 19 being required to be forced past the lugs 21 as the tongue 17 moves into the groove 16. The engagement of the undersurface of the tongue 17 with the bottom of the groove 16 prevents any excessive downward movement of the tongue 17 which could damage the pivot 20.

Figure 2:
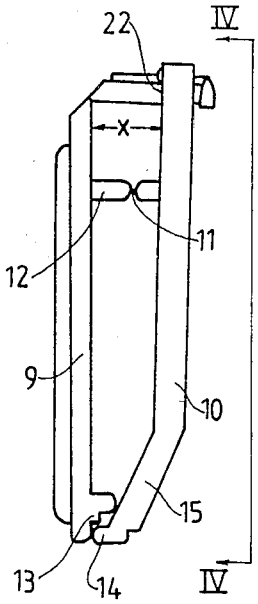
FIG. 2: shows diagrammatically a side view of the left hand side clip of FIG. 1 along arrows II—II.

The distance indicated as "x" in FIG. 2 is such that with a predetermined width of the flange 19 and the relative disposition of the free ends 13 and 14 of the gripping arms 9 and 10, particularly the angle of the inclined portion 15, the free ends 13 and 14 will be biased together to grip an article placed therebetween when the tongue 17 is engaged in the groove 16, see FIG. 2 for example. That is, in engaging the tongue 17 within the groove 16, the upper part of the gripping arm 10 is forced away from the upper part of the gripping arm 9 by the edge 22 of the flange 19. The gripping arm 10 therefore pivots about the pivot 11 and the free ends 13 and 14 are brought together so as to grip a garment or other article previously placed therebetween.

Figure 3:
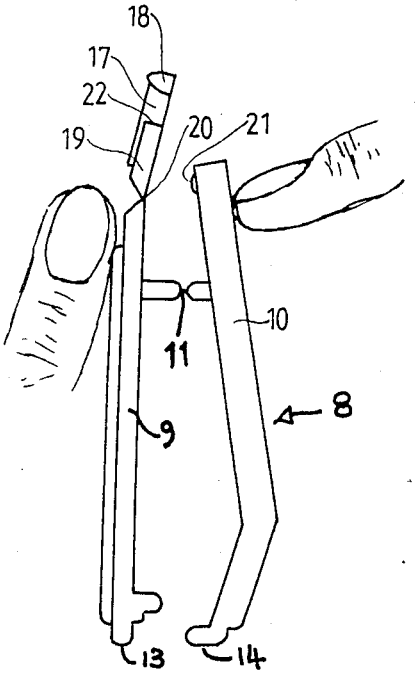
FIG. 3: shows diagrammatically the clip of FIG. 2 when in its open position and being operated to enable the insertion of an article therein.
Figure 4:
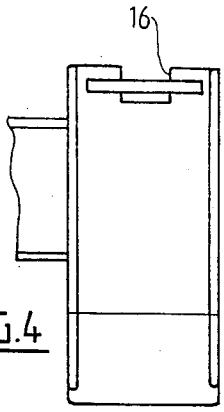
FIG. 4: shows diagrammatically the left hand clip of FIG. 2 in its closed position along arrows IV—IV.
Figure 5:
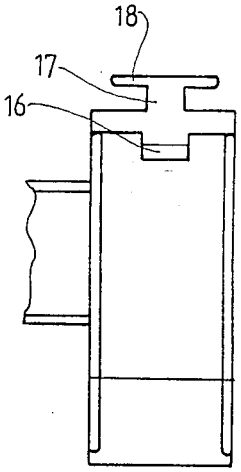
FIG. 5: shows diagrammatically the clip of FIG. 4 in its open position.

On the other hand, with the tongue 17 removed from the groove 16, as shown in FIG. 3, thumb and finger pressure applied across the top ends of the gripping arms 9 and 10 enables the free ends 13 and 14 to disengage. This creates a space into which the garment or other article can be placed prior to the simple action of the tongue 17 being forced into the groove 16 locking the free ends 13 and 14 together again to grip the garment or other article therebetween.

In one embodiment of the invention, the bar 2 and the clips 8 at each end thereof are formed integrally. They may for example be moulded from a suitable plastic material. In another embodiment of the invention the hook 6 is also moulded with, so as to form an integral part of, the bar 2.

In a further embodiment of the invention, the clips 8 are formed as discrete members which are fitted onto the hanger bar at desired positions therealong.

Such embodiments of the invention in which the clips 8 may be provided as discrete components for fitting onto the hanger bar will now be particularly described with reference to other embodiments of the invention shown in FIGS. 6 to 13.

Figure 6:
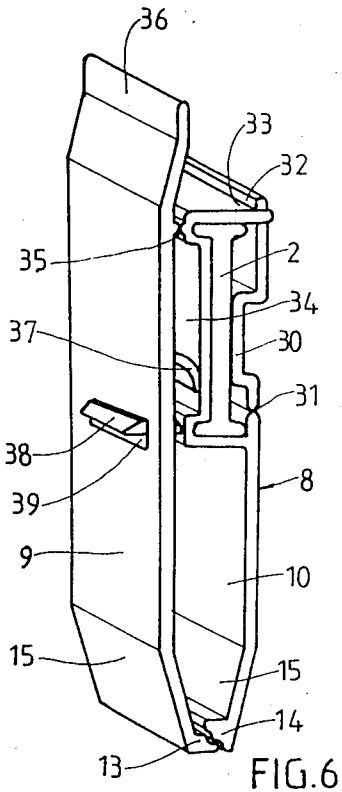
FIG. 6: shows diagrammatically a side perspective view of a clip according to another embodiment of the invention.

Referring firstly to FIG. 6, the hanger bar 2 is shown of a substantially I-cross-section and the clip 8 is shown with its gripping arms 9 and 10 in their closed position and with their respective free ends 13 and 14 closed together. In this embodiment, both of the gripping arms are shown having inclined free end portions 15. The gripping arm 10 is shown having an upper portion 30 which is pivoted relative to the bottom portion of the gripping arm 10. The upper portion 30 is shown having an inwardly directed ledge 32 below which the edge of a flange 33 can be locked so securing clip portions 34 and 30 about the hanger bar 2. The gripping bar 9 is shown pivoted at 35 with the clip portion 34. An upstanding portion 36 can have pressure applied when the free ends 13 and 14 are to be moved apart for the insertion of a garment or other article. The inner surface of the gripping arm 9 is shown provided with an integral lip 37 engageable with the outer surface of the clip portion 34. This provides an outwardly acting bias on the upper portion of the gripping arm 9 tending to bring the free ends 13 and 14 of the gripping arms 9 and 10 together. When a garment or other article has been placed between the free ends 13 and 14, a latch member 38 can be engaged in groove 39 provided in the gripping arm 9. This secures the free ends 13 and 14 together with the garment secured therebetween. The locking of the gripping arms 9 and 10 together will also mean that pressure is applied at least via the lip 37 against the clip portion 34. This enhances the securement of the clip 8 to the hanger bar 2 at the desired position. The clip 8 and the bar 2 may include cooperating longitudinal grooves to assist their engagement.

Figure 7:
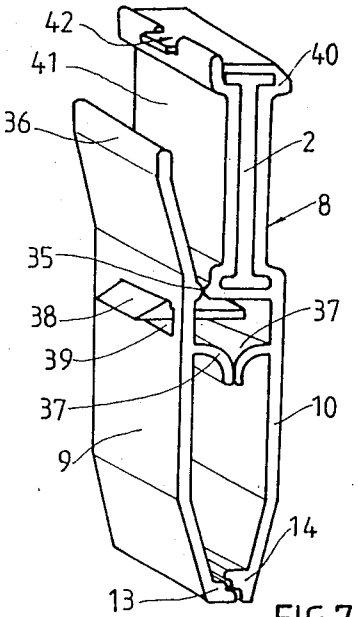
FIG. 7: shows diagrammatically a side perspective view of a clip according to another embodiment of the invention.

In FIG. 7 a further embodiment of the invention is shown in which the gripping arms 9 and 10 each have integral lips 37 engageable with one another and tending to bias the free ends 13 and 14 together. Again the clip 8 is shown as being of a discrete component which can be secured in a desired position about the hanger bar 2 by clip portions 40 and 41 being secured together such as by the tongue and groove assembly 42 illustrated. The pivot point 35 is shown at a lower position in FIG. 7 than in the embodiment shown in FIG. 6 However, a similar latching arrangement between latch 38 and groove 39 has been retained in this embodiment as has a similar form of upstanding operating member 36.

Figure 8:
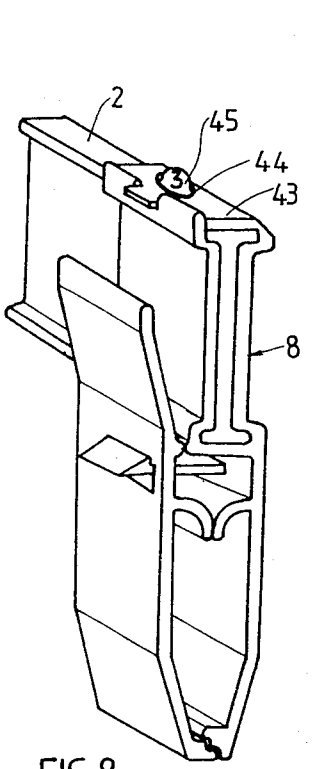
FIG. 8: shows diagrammatically a side perspective view of part of a hanger and a clip therefor according to a further embodiment of the invention.
Figure 9:
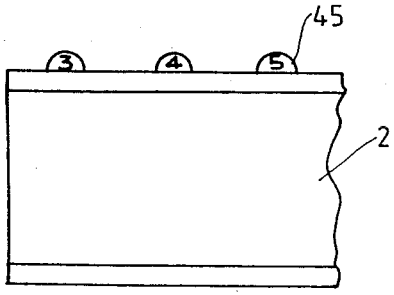
FIG. 9: shows very diagrammatically part of the hanger bar of FIG. 8.

As mentioned previously with respect to FIG. 1, garment size indication or other indicia can be provided by means of the hook 6. However, as shown in FIGS. 8 and 9, it is envisaged that the clip 8 provided as a discrete member, may be means of its movement to a desired position on the hanger bar 2, automatically provide a garment size indication or other indicia. Thus, an upper flange 43 of the clip 8 is shown having an aperture 44 which is engageable over a projecting portion 45 provided on an upper flange of the hanger bar 2, the projection 45 having a suitable indicia thereon such as garment size "3" as shown. It is envisaged that, as shown in FIG. 9, a plurality of projections 45 could be provided so that a desired projection 45 with the requisite indicia could be selected. The size and/or flexibility of the material of the projections 45 will be such that undue stress on or distortion of, the clip 8 does not result, as those projections 45 which are obscured will be positioned under the clip 8.

Figure 10:
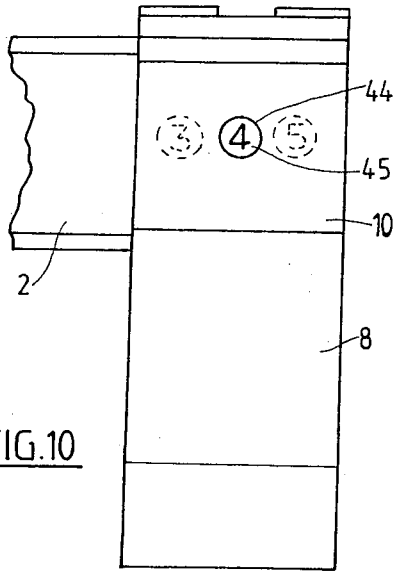
FIG. 10: shows diagrammatically a side view of part of a hanger and a clip therefor according to a further possible embodiment of the invention.

In a further embodiment of the invention as shown in FIG. 10 the clip 8 has an aperture 44 along the side of one of its gripping arms 10 which is locatable over a projection 45 provided along the web of the flange 2. Other projections 45 which have been obscured are shown in outline. It is to be appreciated that the projections 45 as well as providing indicia also provide a detent mechanism which enhances the securement of the discrete clip member 8 on the hanger bar 2.

Figure 11:
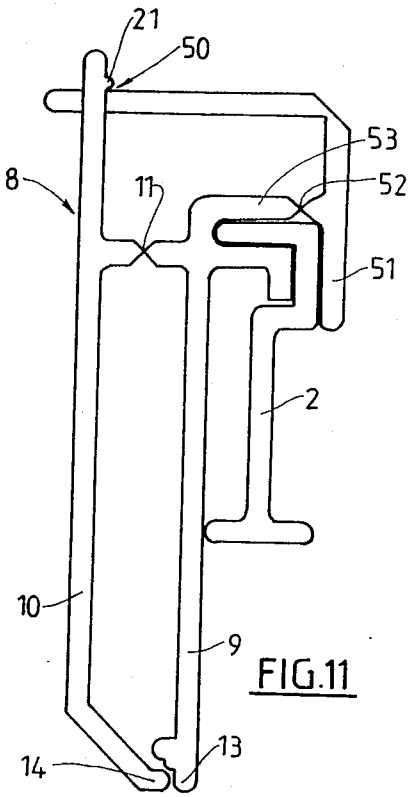
FIG. 11: shows diagrammatically an end view of part of a hanger and clip therefor according to a still further embodiment of the invention.

Referring now to FIG. 11, in a further embodiment of the invention, the clip 8 is shown having its gripping arms 9 and 10 pivotally connected about pivot point 11. The clip 8 is a discrete member lockable in a desired position about the hanger bar 2. To achieve this locking a tongue and groove assembly 50 such as previously described with reference to FIGS. 1 to 5 is shown provided, this including associated projections 21 above the groove. The arrangement is such that in the locked position shown in FIG. 11, in addition to the force acting on the gripping arm 10 which biases the free ends 13 and 14 together, a force is also acting on the flange member 51 pivoted about 52 with the top portion 53 of the gripping arm 9. This additional force biases the flange portion 51 against the hanger bar 2 so as to secure the clip 8 and hanger bar 2 together.

While a particular cross-section of hanger bar 2 and clip 8 have been indicated, it is to be appreciated that this is by way of example only.

Figure 12:
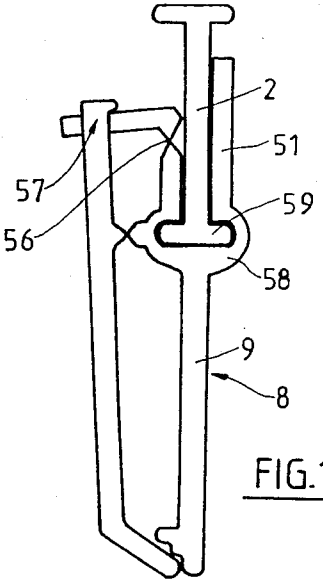
FIG. 12: shows diagrammatically an end view of part of a hanger and clip therefor according to a still further embodiment of the invention.

Turning now to FIG. 12, in a further embodiment of the invention, the clip 8 is again shown as a discrete component. The clip 8 is secured to a bottom portion of the hanger bar 2, and a bulbous portion 58 of the gripping arm 9 of the clip 8 has a slot accommodating the bottom flange of the bar 2. An upstanding flange 51 of the gripping arm 9 is shown positioned on one side of the web of the bar 2. A pivot 56 combined with a tongue and groove assembly 57, such as previously described with reference to the embodiment of FIG. 11 for example, provides the bias for the engagement of the free ends of the gripping arm and also for pressure to be applied to the web of the hanger bar 2 in enhancing the securement of the clip 8 thereto.

Figure 13:
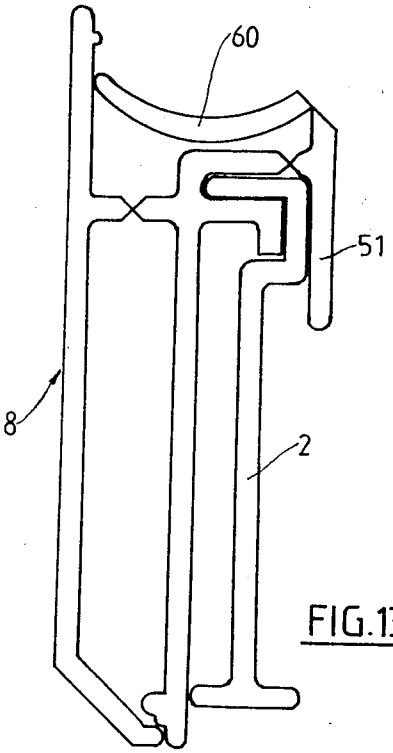
FIG. 13: shows diagrammatically an end view of part of a hanger and clip therefor according to a still further embodiment of the invention.

Turning now to FIG. 13, in a further embodiment of the invention, a design of clip and hanger bar similar to that shown in FIG. 11, is illustrated. However, the hanger bar 2 is shown having a somewhat wider web and furthermore the tongue and groove assembly 50 has been replaced by an arcuate pivoted member 60. This member 60, in the locked position of the clip 8, is engaged against an inner surface of one of the gripping arms. The arcuate shape and flexibility of the material of the member 60 is such that a required bias is applied to the free ends of the gripping arms to hold them together as well as a desired pressure being applied by the flange 51 against the hanger bar 2.

It is thus seen that where embodiments of the invention utilize a discrete clip, the clip is such that in achieving its desired gripping action on the garment or other article required to be held, an enhanced securement of the clip at the desired position on the hanger bar can also be achieved.

In the embodiments of the invention where a discrete clip member has been described, it will be appreciated that as an alternative an integral member could alternatively be utilized subject to appropriate design modifications as may be necessary.

Where in the aforegoing description reference has been made to specific components or integers of the invention having known equivalents, then such equivalents are herein incorporated as if individually set forth.

Although this invention has been described by way of example and with reference to possible embodiments thereof, it is to be understood that modifications or improvements may be made thereto without departing from the scope of the invention as defined in the appended claims.

I claim:

1. A combination hanger and clip for hanging garments and other articles therefrom, comprising:

(a) an elongated hanger bar;

(b) support means associated with said bar for permitting the hanging of said bar from a support member;

(c) at least one clip provided on said bar, said clip being of an integral one-piece construction and comprising a pair of gripping arms pivotally movable relative to each other, said gripping arms being respectively formed with lower, free end portions movable between a first, open position in which the ends are spaced, and a second, closed position in which the ends are adjacently positioned for securing a garment therebetween, a pivotal connection between said gripping arms comprised of a connecting arm integrally formed with said arms and extending between respective inner surfaces of said gripping arms, said connecting arm having a portion of lesser thickness intermediate its length about which said gripping arms can pivot; and (d) locking means for locking said free ends of said gripping arms in said second position for securely gripping the garment placed between said free ends, said locking means comprising first and second parts intergrally formed at respective upper end portions of said gripping arms, said parts being releasable to permit said free ends to be moved to said first position in which said garment can be released.

2. The hanger and clip as claimed in claim 1, wherein said support means comprises a separately formed hook member, said hook member and said hanger bar having respective engagement means which can be engaged to hold said hook member and said hanger bar together, said hook member being formed with indicia means to indicate clothes size.

3. A hanger as claimed in claim 1 wherein said locking means is provided at respective ends of said gripping arms opposite to said respective free ends and wherein said locking means comprises a tongue member pivotable on one of said gripping arms to engage within a groove on the other of said gripping arms.

4. A hanger as claimed in claim 3 wherein projection means are provided on said other of said gripping arms above said groove and past which a free edge adjacent said tongue member must be forced in engaging said tongue member within said groove.

5. A hanger as claimed in claim 1 wherein said support includes a discrete hanger hook member a lower portion of which is engageable with a projecting portion of said bar.

6. A hanger as claimed in claim 1 wherein said bar includes a plurality of upstanding projections each of which has provided therein indicia, said clip is provided as a discrete member movable along said bar and is provided with an aperture engageable over a selected one of said projecting portions to expose the indicia provided thereon.

7. A clip of an integral one-piece construction for hanging garments and other articles therefrom, said clip comprising a pair of gripping arms pivotally movable relative to each other, said gripping arms being respectively formed with lower, free end portions movable between a first, open position in which the ends are spaced, and a second, closed position in which the ends are adjacently positioned for securing a garment therebetween, a pivotal connection between said gripping arms comprised of a connecting arm integrally formed with said arms and extending between respective inner surfaces of said gripping arms, said connecting arm having a portion of lesser thickness intermediate its length about which said gripping arms can pivot; and locking means for locking said free ends of said gripping arms in said second position for securely gripping the garment placed between said free ends, said locking means comprising first and second parts integrally formed at respective upper end portions of said gripping arms, said parts being releasable to permit said free ends to be moved to said first position in which said garment can be released.

8. A clip as claimed in claim 7, wherein said first part of said locking means comprises a tongue member pivotable on one of said gripping arms and having a head portion at its free end, and said other part comprises a groove on the other of said gripping arms engageable by said tongue member, and wherein projection means are provided on said other of said gripping arms adjacent said groove and past which said head portion must be forced in engaging said tongue member within said groove.

9. A clip as claimed in claim 7, wherein operation of said locking means to hold said gripping arms in said first position also holds said clip, in use, at a desired position on a hanger.

10. A clip as claimed in claim 9, wherein said locking means includes a flange member pivotally connected with one of said gripping arms and integrally formed with a tongue member, operation of said tongue member effecting the pivoting of said flange member to bias it, in use, against said hanger.

11. A clip as claimed in claim 7, further including a hanger bar on which said clip is slidably mounted, said hanger bar having means bearing indicia, and said clip being formed with an aperture adapted to overlie a respective indicia to indicate a feature of the hanging garment or other article.

12. A clip as claimed in claim 11, wherein said means bearing indicia comprise a plurality of spaced projections, each of which is adapted to extend through said aperture.

* * * * *